US007061464B2

(12) United States Patent
Park et al.

(10) Patent No.: US 7,061,464 B2
(45) Date of Patent: Jun. 13, 2006

(54) LIQUID CRYSTAL DISPLAY AND METHOD FOR DRIVING THE SAME

(75) Inventors: Jung Kook Park, Kyoungki-do (KR); Byeong Jin Kim, Kyoungki-do (KR)

(73) Assignee: Boe-Hydis Technology Co., Ltd., Kyoungki-do (KR)

( * ) Notice: Subject to any disclaimer, the term of this patent is extended or adjusted under 35 U.S.C. 154(b) by 379 days.

(21) Appl. No.: 10/619,277

(22) Filed: Jul. 14, 2003

(65) Prior Publication Data

US 2004/0178984 A1 Sep. 16, 2004

(30) Foreign Application Priority Data

Mar. 10, 2003 (KR) ..... 10-2003-0014826

(51) Int. Cl.
*G09G 3/36* (2006.01)

(52) U.S. Cl. ..... 345/98; 345/89

(58) Field of Classification Search ..... 345/87–101
See application file for complete search history.

(56) References Cited

U.S. PATENT DOCUMENTS

| | | | | |
|---|---|---|---|---|
| 5,495,265 | A * | 2/1996 | Hartman et al. | 345/87 |
| 5,905,484 | A * | 5/1999 | Verhulst | 345/98 |
| 6,466,225 | B1 * | 10/2002 | Larkin et al. | 345/596 |
| 6,700,559 | B1 * | 3/2004 | Tanaka et al. | 345/88 |
| 2001/0038372 | A1 * | 11/2001 | Lee | 345/89 |
| 2003/0048245 | A1 * | 3/2003 | Ham | 345/87 |
| 2003/0058211 | A1 * | 3/2003 | Kim et al. | 345/89 |
| 2003/0098839 | A1 * | 5/2003 | Lee | 345/89 |
| 2003/0231158 | A1 * | 12/2003 | Someya et al. | 345/101 |

FOREIGN PATENT DOCUMENTS

KR 20030004049 1/2003

OTHER PUBLICATIONS

Shawn Carlson, "Detecting the Earth's Electricity", Jul. 1999, Scientific American.com.*

* cited by examiner

*Primary Examiner*—Amr A. Awad
*Assistant Examiner*—Steven Holton
(74) *Attorney, Agent, or Firm*—Ladas & Parry LLP

(57) ABSTRACT

Disclosed is a liquid crystal display (LCD) and method for driving the same, in which a rapid response characteristic of the liquid crystal is secured employing a charge-sharing driving mode. The LCD comprises a data storage unit for storing present input data and outputting the stored present input data as previous input data, a look-up table for storing corrected present and previous input data, each of which corresponds to the present and previous input data, a control unit for generating first and second load signals, storing the present input data at the data storage unit, reading out the previous input data from the data storage unit, converting the present and previous input data into the corrected present and previous input data with reference to the look-up table, calculating a mean value based on the corrected present and previous input data, and outputting free-charge data by replacing the calculated mean value with a value approximating to original gray scale data, and a liquid crystal driving unit for converting the free-charge data into analog signals and generating liquid crystal driving signals based on the converted analog signals in response to the first and second load signals.

7 Claims, 4 Drawing Sheets

| Dn | analog voltage(V) | ↔ | Dn" |
|---|---|---|---|
| L0 | 0.2 | ↔ | L0" |
| L1 | 0.4 | ↔ | L1" |
| L2 | 0.6 | ↔ | L2" |
| · | | ↔ | · |
| · | | ↔ | · |
| · | | ↔ | · |
| L61 | 7 | ↔ | L61" |
| L62 | 7.5 | ↔ | L62" |
| L63 | 8 | ↔ | L63" |

LIQUID CRYSTAL DISPLAY AND METHOD FOR DRIVING THE SAME

BACKGROUND OF THE INVENTION

1. Field of the Invention

The present invention relates to a liquid crystal display (LCD) and method for driving the same, in particular improving a response characteristic of a liquid crystal employing a charge-sharing driving mode.

2. Description of the Prior Art

In general, LCDs, as devices for displaying an image by adjusting light transmittance through a change in alignment of liquid crystal molecules under the action of an electric field, have been developed from a TN-LCD (Twisted Nematic LCD) to an STN-LCD (Super Twisted Nematic LCD), a MIM-LCD (Metal Insulator Metal LCD) and a TFT-LCD (Thin Film Transistor LCD) in that order, and simultaneously their display performance has been remarkably improved. Such LCDs have drawn attention as a device capable of substituting for CRTs (Cathode Ray Tubes) due to an advantage in that it is possible to make lighter and simpler, and has a tendency toward gradual increase in demand as it has widely applied to notebook computers or mobile communication apparatuses.

However, as for LCDs, due to specific characteristics of the liquid crystal molecule, a time delay is accompanied to control the alignment of the liquid crystal molecules, and at the same time response speed of the liquid crystal molecule is slower than a conversion speed of a frame. This acts as a main cause making an image outline blurry or deteriorating a quality of image when establishing moving pictures.

One technique, which has been generally used to solve these problems, is to accelerate the response speed of the liquid crystal molecule. To this end, a level of previous input data is compared with that of present input data, and then an LCD panel is subject to over-driving at the maximum and minimum output voltages of a source driver integrated circuit. Such a technique is disclosed in Korean unexamined patent application publication No. 2003-4049, filed on Jun. 25, 2002.

The conventional LCD as mentioned above incurs overshoot and under-shoot of an output voltage, due to excessive adjustment of the output voltage of a liquid crystal driving unit, that is, the source driver IC, and thus excessive stress is applied to an output buffer of the source driver IC.

Additionally, during over-driving, a DC/DC converter applying a supply voltage to the source driver IC is subject to strong load fluctuation, thereby deteriorating stability and load adjustment capability. This output instability of the DC/DC converter has an influence on its peripheral element such as a timing controller, thereby causing interference to high-frequency clocks and data.

Therefore, the conventional LCD has problems in that consumption of electric power is increased as a whole due to over-driving, and that the liquid crystals themselves are deteriorated due to applied stress.

SUMMARY OF THE INVENTION

Accordingly, the present invention has been made to solve the above-mentioned problems occurring in the prior art, and an object of the present invention is to provide a liquid crystal display (LCD) and method for driving the same, in which pre-charge data having a middle level between present input data and previous input data are generated to perform pre-charging of a liquid crystal driving unit with reference to a preset look-up table, and thereby a response speed of the liquid crystal can be improved and at the same time consumption of electric power can be saved.

In order to accomplish this object, there is provided a liquid crystal display (LCD), comprising: a data storing means for storing present input data and outputting the stored present input data as previous input data; a look-up table for storing corrected present input data and corrected previous input data, each of which corresponds to the present input data and the previous input data; a controlling means for generating first and second load signals, storing the present input data at the data storing means, reading out the previous input data from the data storing means, converting the present input data and the previous input data into the corrected present input data and the corrected previous input data with reference to the look-up table, calculating a mean value based on the corrected present input data and the corrected previous in put data, replacing the calculated mean value with a value approximating to original gray scale data, and outputting the replaced value as pre-charge data; and a liquid crystal driving means for converting the pre-charge data into analog signals and generating liquid crystal driving signals based on the converted analog signals in response to the first and second load signals.

Further, in order to accomplish this object, there is provided a method for driving a liquid crystal display (LCD) with a look-up table, in which the look-up table has a plurality of analog voltages corresponding to a plurality of gray scale data, the method comprising the steps of: storing present input data at a data storage unit; reading out the present input data stored at the data storage unit as previous input data; converting the present input data and the previous input data into corrected present input data and corrected previous input data respectively with reference to the look-up table; calculating a mean value based on the corrected present input data and the corrected previous input data; generating pre-charge data by replacing the calculated mean value with a value approximating to original gray scale data and; converting the pre-charge data into analog signals and performing sampling and holding of the converted results; and amplifying the sampled and held analog signals to generate liquid crystal driving signals.

It is preferable that the step of generating the pre-charge data comprises the sub-steps of: adding a predetermined weight to the calculated mean value, and performing rounding off the mean value added by the weight.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described in detail with reference to the accompanying drawings.

Figure 1:
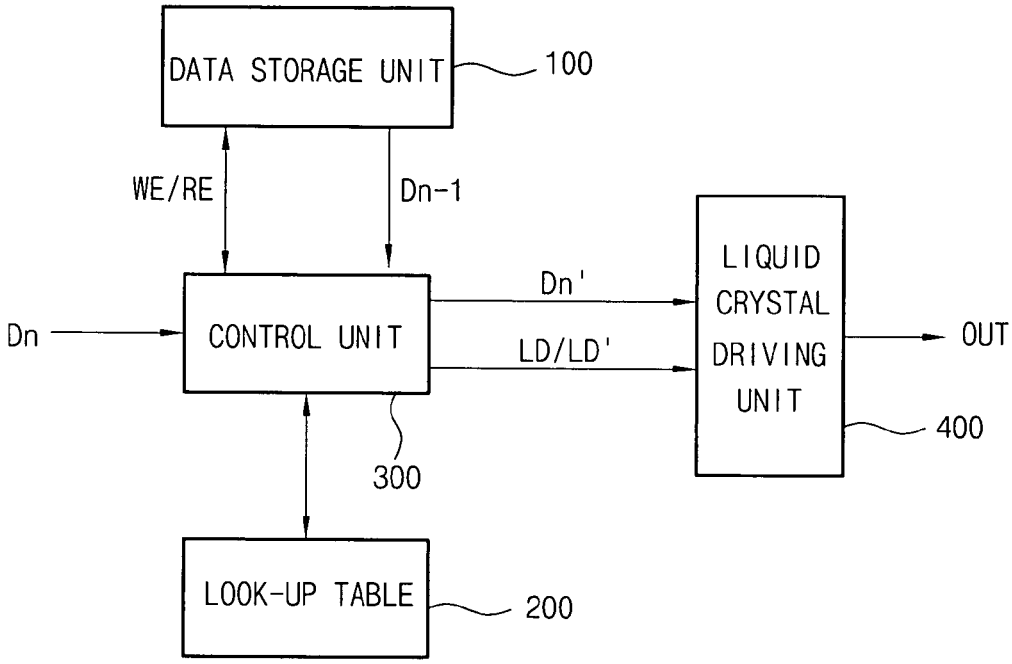
FIG. 1 is a block diagram showing a liquid crystal display (LCD) of the present invention.

FIG. 1 is a block diagram showing a liquid crystal display (LCD) of the present invention. As shown, the LCD includes a data storage unit 100, a look-up table 200, a control unit 300 and a liquid crystal driving unit 400. The data storage unit 100 is made up of a frame memory and receives write enable (WE) signals and read enable (RE) signals from the control unit 300. The look-up table 200 may be included in the control unit 300, and is provided with preset 64 gray scale analog voltages, each of which corresponds to present input data Dn in a one-to-one mode. The control unit 300, as a timing controller generating data signals and a plurality of control signals for driving the liquid crystals, receives the present input data Dn from an external apparatus. Then, the control unit 300 stores the present input data Dn at a predetermined address area of the data storage unit 100 through activation of the WF s and reads the present input data Dn stored at the data storage unit 100 as the previous input data Dn-1 through activation of the RE signals.

Further, the control unit 300 generates first and second load signals LD and LD', and converts analog voltages corresponding to the present and previous input data Dn and Dn-1 into respectively corrected present and previous input data Dn" and Dn-1" with reference to the look-up table 200. A mean value is calculated based on the corrected present and previous input data Dn" and Dn-1". The calculated mean value is replaced with a value approximating to original gray scale data, and then outputted as pre-charge data Dn'.

The liquid crystal driving unit 400, as the source driver IC, converts the pre-charge data Dn' into analog signals, and generates liquid crystal driving signals OUT based on the converted analog signals in response to the first and second load signals LD and LD'.

Figure 2:
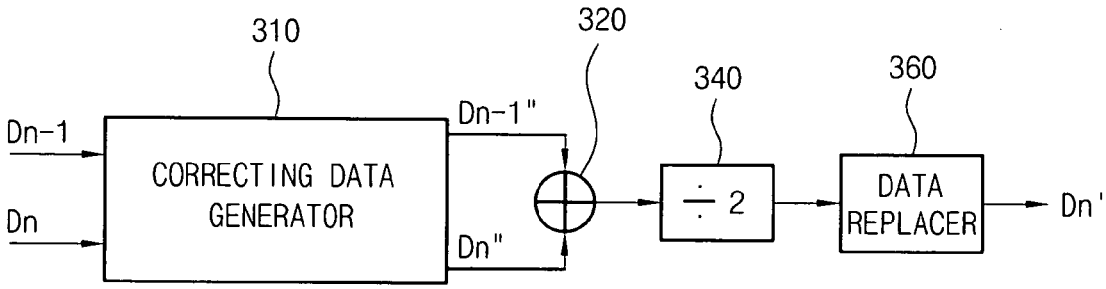
FIG. 2 is a block diagram showing an internal construction of a timing controller according to the present invention.

FIG. 2 is a block diagram showing an internal construction of a timing controller according to the present invention. As shown, the timing controller includes a correcting data generator 310 for converting and outputting the present and previous input data Dn and Dn-1 into respectively corrected present and previous input data Dn" and Dn-1" with reference to the look-up table 200, an adder 320 for adding both the corrected present and previous input data Dn" and Dn-1", a divider 340 for dividing the data added by the adder 320 in order to calculate a mean value, and a data replacer 360 for replacing the mean value calculated by the divider 340 with a value approximating to the original gray scale data and outputting the replaced value.

According to the present invention, the data replacer 360 adds a weight of 0.5 to the mean value, and then performs data replacement through rounding off. To replace the data in this manner is to get pre-charge data to a middle level between the present and previous input data Dn and Dn-1 in order to accomplish a rapid response characteristic of the liquid crystal because the outputs of the source driver IC corresponding to the inputted digital data are non-linear.

Figures 3, 4:
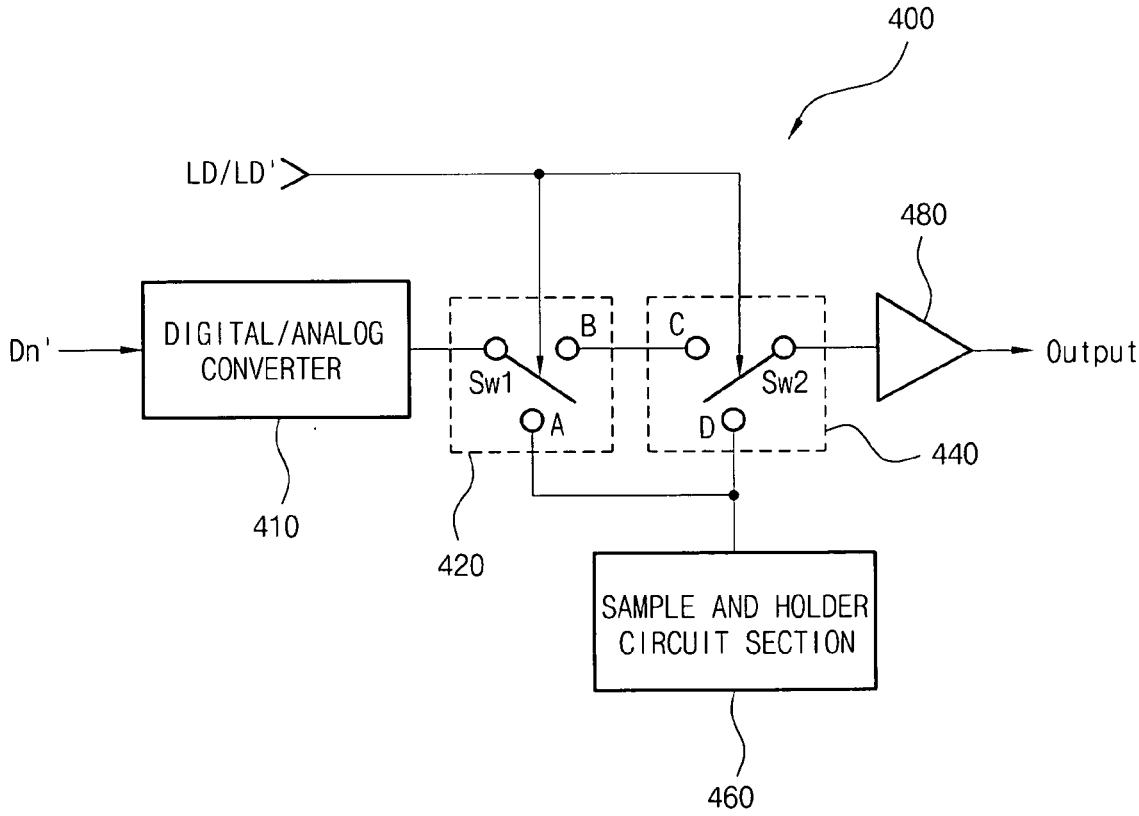
FIG. 3 shows a look-up table according to the present invention.
FIG. 4 is a block diagram showing an internal construction of a liquid crystal driving unit 400 according to the present invention.

FIG. 3 shows a look-up table according to the present invention. As shown, the present input data values L0 to L63 correspond to 64 gray scales of preset analog voltages. For example, the value L0 corresponds to the analog voltage of 0.2 V, and the value L63 corresponds to the analog voltage of 8 V.

The control unit 300 according to the present invention converts the present input data Dn into the corrected present input data Dn" with reference to the analog voltages of the look-up table 200, and generates corrected previous input data Dn-1" through conversion similar to the forgoing with respect to the previous input data Dn-1.

FIG. 4 is a block diagram showing an internal construction of a liquid crystal driving unit 400 according to the present invention. As shown, the liquid crystal driving unit 400 includes a digital/analog converter 410, a first switch 420, a second switch 440, a sample and holder circuit section 460 and an output amplifier 480.

The digital/analog converter 410 converts pre-charge data D' outputted from the control unit 300 into analog signals, and outputs the converted results to the first switch 420. To get the rapid response characteristics of the liquid crystal, the first switch 420 forms a current passage to a terminal A of the sample and holder circuit section 460 by means of switching in response to the first load signal LD. Further, the second switch 440 forms a current passage to a terminal D of the sample and holder circuit section 460 by means of switching in response to the second load signal LD'. When the current passage to the terminal A is formed by switching of the first switch 420, the sample and holder circuit section 460 receives output signals of the digital/analog converter 410 and performs sampling and holding of the received signals. When the current passage to the terminal D is formed by switching of the second switch 440, the output amplifier 480 amplifies signals, which am subject to sampling and holding at the sample and hold circuit section 460, to a predetermined level, and outputs the amplified signals to an LCD panel (not shown).

Figure 5:
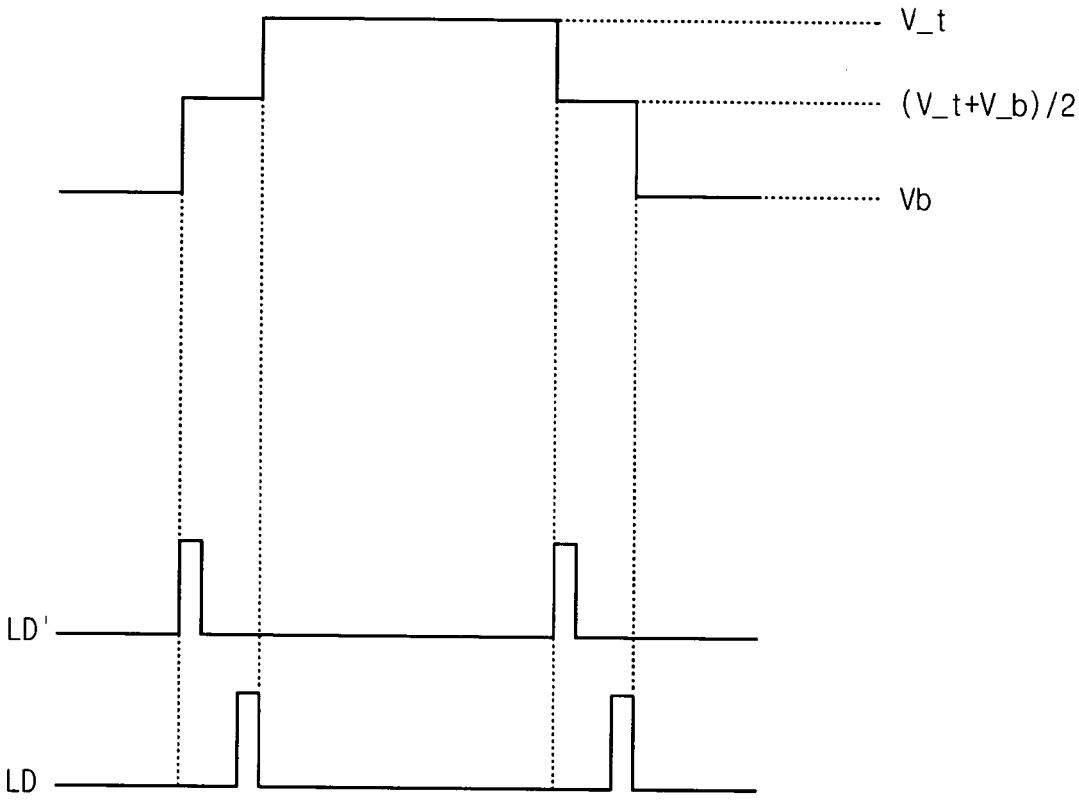
FIG. 5 is a timing diagram showing an outputted waveform of a liquid crystal driving unit according to the present invention.

FIG. 5 is a timing diagram showing an outputted waveform of a liquid crystal driving unit according to the present invention.

As can be seen from FIG. 5, the liquid crystal driving unit 400 according to the present invention performs sampling and holding of a pre-charge data signal Dn' through switching of the switches 420 and 440 in response of an downward edge of the first load signal LD and an upward edge of the second load signal LD', which are generated from the control unit 300, and thus generating an output voltage, $(V_t+V_b)/2$, corresponding to a middle level between the maximum voltage $V_t$ and the minimum voltage $V_b$.

When TFT-LCD is driven by this middle level of output voltage, consumption of electric power can be saved up to maximum of 66.6%.

Figure 6:
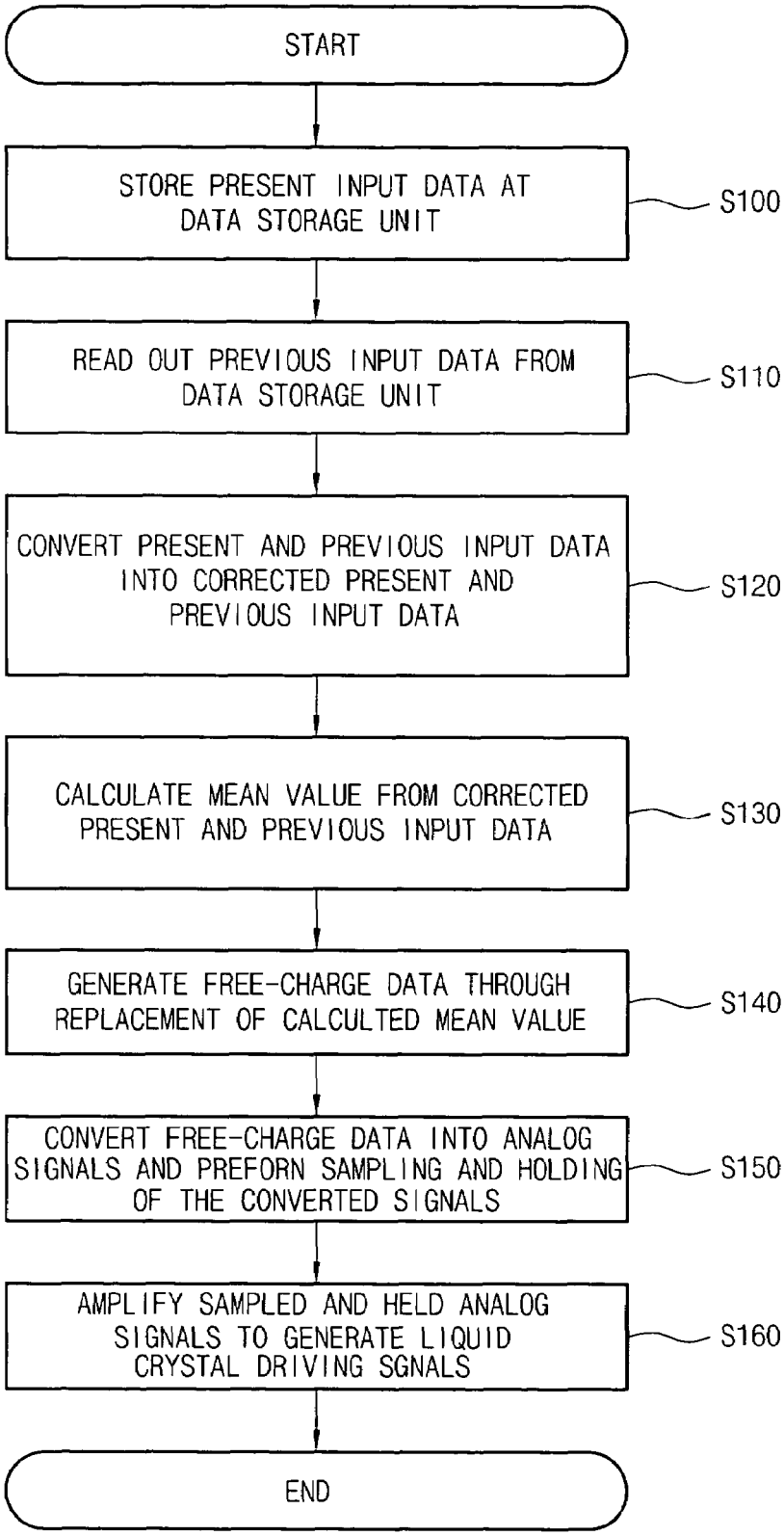
FIG. 6 is a flow chart for explaining a method for driving the LCD according to the present invention.

A description will be made below regarding a method for driving the LCD according to the present invention with reference to a flow chart of FIG. 6.

First, present input data Dn inputted from an external apparatus are stored at the data storage unit 100 when the WE signals are activated (S100). The present input data Dn stored at the data storage unit 100 are read out as the previous input data Dn-1 before the RE signals are activated (S110).

Then, the correcting data generator 310 of the control unit 300 converts the present and previous input data Dn and Dn-1, which are inputted from the external apparatus, into the corrected present and previous input data Dn" and Dn-1" on the basis of the look-up table 200 (S210).

Subsequently, the adder 320 of the control unit 300 adds the corrected present and previous input data Dn" and Dn-1", and the divider 340 divides the data added at the adder 320 by a divisor of 2. Thus, a mean value between the corrected present and previous input data Dn" and Dn-1" is yielded (S130).

Next, the data replacer 360 of the control unit 300 adds a weight of 0.5 to the mean value, performs rounding off, and replaces the mean value with a value approximating to a plurality of gray scale data, thereby generating pre-charge data (S140).

The digital/analog converter 410 of the liquid crystal driving unit 400 converts the pre-charge data generated from the data replacer 360 into analog signals. The sample and hold circuit section 460 performs sampling and holding of the analog signals converted by the digital/analog converter 410 according to switching operation of the first and second switches 420 and 440 (S150).

When step 150 is completed, the output amplifier 480 of the liquid crystal driving unit 400 amplifies the analog signals which are subjected to sampling and holding by the sample and hold circuit section 460 to a predetermined level, and then generating liquid crystal driving signals for driving the TFT-LCD (S160).

As can be seen from the foregoing, according to the present invention, a middle level of pre-charge data are generated from the present and previous input data with reference to the preset look-up table, and the liquid crystal driving unit is pre-charged, and thereby the TFT-LCD using normal liquid crystals can be operated at a rapid response time without the influence of over-shoot and under-shoot, and consumption of electric power can be significantly reduced as compared with an existing over-driving mode.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A liquid crystal display (LCD), comprising:

a data storing device, which stores present input data and which outputs previously stored present input data as previous input data;

a look-up table device that stores a predetermined number of values, each of which represents a preset analog voltage value, for storing corrected present input data and corrected previous input data, each of which corresponds to the present input data and the previous input data;

a controller that:

generates first and second load signals, stores a first present input data in the data storing device, reads out a first previous input data from the data storing device, converts the first present input data and the first previous input data into a first corrected present input data and a first corrected previous input data with reference to the look-up table device, calculates a mean value of the first corrected present input data and the first corrected previous input data, replaces the calculated mean value with a value approximating an original gray scale data value, and outputs the replaced value as pre-charge data; and a liquid crystal driver that converts the pre-charge data into analog signals and generating liquid crystal driving signals based on the converted analog signals in response to the first and second load signals.

2. An LCD as claimed in claim 1, wherein the look-up table stores preset 64 gray scale analog voltages, each of which corresponds to present input data.

3. An LCD as claimed in claim 1, wherein the controller comprises a correcting data generator for converting and outputting the present input data and the previous input data into the corrected present input data and the corrected previous input data with reference to the look-up table, an adder for adding both th corrected present input data and the corrected previous input data, a divider for dividing the data added by the adder to calculate a mean value, and a data replacer for replacing the mean value calculated by the divider with the value approximating to the original gray scale data and outputting the replaced value.

4. An LCD as claimed in claim 2, wherein the data replacer adds a predetermined weight to the mean value calculated by the divider and performs data replacement through rounding off.

5. An LCD as claimed in claim 1, wherein the liquid crystal driver comprises a digital/analog converter for converting and outputting the pre-charge data into the analog signals, a first switch for performing switching in response to the first load signal, a second switch for performing switching in response to the second load signal, a sample and holder circuit section for performing sampling and holding of output signals of the digital/analog converter when the first switch is switched, an output amplifier for amplifying and outputting the sampled and held signals when the second switch is switched.

6. A method for driving a liquid crystal display (LCD) with a look-up table, in which the look-up table has a plurality of analog voltages corresponding to a plurality of gray scale data, the method comprising the steps of:

storing present input data at a data storage unit;

reading from the data storage unit, previously stored present input data stored as previous input data;

converting the present input data and the previous input data into corrected present input data and corrected previous input data respectively, with reference to the look-up table;

calculating a mean value of the corrected present input data and the corrected previous input data;

generating pre-charge data by replacing the calculated mean value with a value approximating to original gray scale data and;

converting the pre-charge data into analog signals and performing sampling and holding of the converted results;

and amplifying the sampled and held analog signals to generate liquid crystal driving signals.

7. A method as claimed in claim 6, wherein the step of generating the pre-charge data comprises the sub-steps of:

adding a predetermined weight to the calculated mean value, and performing rounding off the mean value added by the weight.

* * * * *